US008927925B2

(12) United States Patent
Kuehl et al.

(10) Patent No.: US 8,927,925 B2
(45) Date of Patent: Jan. 6, 2015

(54) INTERACTIVE METHOD FOR IDENTIFYING IONS FROM MASS SPECTRAL DATA

(75) Inventors: Donald Kuehl, Windham, NH (US); Yongdong Wang, Wilton, CT (US); Ming Gu, Yardley, PA (US)

(73) Assignee: Cerno Bioscience LLC, Danbury, CT (US)

( * ) Notice: Subject to any disclaimer, the term of this patent is extended or adjusted under 35 U.S.C. 154(b) by 267 days.

(21) Appl. No.: 12/475,548

(22) Filed: May 31, 2009

(65) Prior Publication Data

US 2009/0302213 A1 Dec. 10, 2009

Related U.S. Application Data

(60) Provisional application No. 61/057,804, filed on May 30, 2008.

(51) Int. Cl.
*H01J 49/00* (2006.01)

(52) U.S. Cl.
CPC ..... *H01J 49/0036* (2013.01); *H01J 49/0009* (2013.01)
USPC ..... 250/282; 250/283; 250/288

(58) Field of Classification Search
USPC ..... 250/282
See application file for complete search history.

(56) References Cited

U.S. PATENT DOCUMENTS

| | | | | |
|---|---|---|---|---|
| 5,481,476 | A * | 1/1996 | Windig | 702/31 |
| 6,983,213 | B2 * | 1/2006 | Wang | 702/85 |
| 7,800,055 | B2 * | 9/2010 | Geromanos et al. | 250/288 |

* cited by examiner

*Primary Examiner* — Phillip A Johnston
(74) *Attorney, Agent, or Firm* — Ohlandt, Greeley, Ruggiero & Perle, L.L.P.

(57) ABSTRACT

A method for identifying ions that generated mass spectral data, comprises acquiring raw mass spectral data in profile mode containing at least one ion of interest; performing at least one of mass spectral calibration involving peak shape and a determination of actual peak shape function associated with the acquired raw mass spectral data; considering at least one possible elemental composition of the ion; calculating theoretical mass spectral data for said elemental composition using the actual peak shape function; performing a normalization between corresponding parts of the theoretical mass spectral data and that of the raw or calibrated mass spectral data; and displaying mass spectral congruence between at least two mass spectra where one spectrum is the normalized version of the other corresponding to said possible elemental composition. The unique display and method assist in readily identifying ions. A data storage medium having computer code thereon for causing a computer to performing the method; also in combination with a mass spectrometer.

23 Claims, 9 Drawing Sheets

RT Windows

Average of Scans 7 thru 49 (0.12 to 0.87)

CLIPS Parameters

| | |
|---|---|
| Accurate Mass: | 399.1432 |
| Charge: | 1 |
| Mass Tolerance (mDa): | 15.00 |
| Electron State: | Even |

Double Bond Equivalent Range

| | |
|---|---|
| Minimum: | -30.00 |
| Maximum: | 50.00 |

Profile Mass Range (Da)

| | |
|---|---|
| Start: | -0.50 |
| End: | 4.50 |

| Element | Minimum | Maximum |
|---|---|---|
| C | 0 | 50 |
| H | 0 | 100 |
| N | 0 | 10 |
| O | 0 | 10 |

CLIPS Search Results

| | Formula | Mono Isotope | Mass Error (mDa) | Mass Error (PPM) | Spectral Accuracy | RMSE | DBE |
|---|---|---|---|---|---|---|---|
| 1 | C24H19N2O4 | 399.1345 | 8.7179 | 21.8415 | 96.0291 | 446,474 | 16.5 |
| 2 | C23H19N4O3 | 399.1457 | -2.5155 | -6.3022 | 95.7385 | 479,148 | 16.5 |
| 3 | C25H15N6 | 399.1358 | 7.3805 | 18.4908 | 95.6524 | 488,822 | 21.5 |
| 4 | C22H19N5O2 | 399.1569 | -13.7489 | -34.4460 | 95.4362 | 513,132 | 16.5 |
| 5 | C28H19N2O | 399.1497 | -6.5382 | -16.3807 | 95.3919 | 518,111 | 20.5 |
| 6 | C29H19O2 | 399.1385 | 4.6951 | 11.7631 | 95.3846 | 518,931 | 20.5 |
| 7 | C22H23O7 | 399.1444 | -1.1781 | -2.9516 | 95.0179 | 560,166 | 11.5 |
| 8 | C20H15N8O2 | 399.1318 | 11.4032 | 28.5693 | 94.7196 | 593,705 | 17.5 |
| 9 | C21H23N2O6 | 399.1556 | -12.4115 | -31.0953 | 94.6564 | 600,807 | 11.5 |
| 10 | C19H15N10O | 399.1430 | .1698 | .4255 | 94.3756 | 632,384 | 17.5 |
| 11 | C19H19N4O6 | 399.1305 | 12.7406 | 31.9200 | 93.6304 | 716,163 | 12.5 |
| 12 | C18H19N5O5 | 399.1417 | 1.5072 | 3.7762 | 93.2639 | 757,378 | 12.5 |
| 13 | C17H19N8O4 | 399.1529 | -9.7261 | -24.3675 | 92.8977 | 798,554 | 12.5 |
| 14 | C18H23O10 | 399.1291 | 14.0780 | 35.2707 | 92.1098 | 887,133 | 7.5 |
| 15 | C17H23N2O9 | 399.1404 | 2.8447 | 7.1269 | 91.7476 | 927,856 | 7.5 |
| 16 | C16H23N4O8 | 399.1516 | -8.3887 | -21.0169 | 91.3857 | 968,552 | 7.5 |
| 17 | C13H19N8O7 | 399.1377 | 5.5300 | 13.8547 | 89.8500 | 1,141,216 | 8.5 |
| 18 | C12H19N10O6 | 399.1489 | -5.7034 | -14.2891 | 89.4928 | 1,181,386 | 8.5 |
| 19 | C11H23N6O10 | 399.1476 | -4.3660 | -10.9384 | 87.7416 | 1,378,279 | 3.5 |
| 20 | C8H19N10O9 | 399.1336 | 9.5527 | 23.9331 | 86.1880 | 1,552,957 | 4.5 |

Fig. 5

RT Windows

Average of Scans 7 thru 49 (0.12 to 0.87)

CLIPS Parameters

| | |
|---|---|
| Accurate Mass: | 399.1432 |
| Charge: | 1 |
| Mass Tolerance (mDa): | 15.00 |
| Electron State: | Even |

Double Bond Equivalent Range

| | |
|---|---|
| Minimum: | -30.00 |
| Maximum: | 50.00 |

Profile Mass Range (Da)

| | |
|---|---|
| Start: | -0.50 |
| End: | 4.50 |

| Element | Minimum | Maximum |
|---|---|---|
| C | 0 | 50 |
| H | 0 | 100 |
| N | 0 | 10 |
| O | 0 | 10 |
| S | 0 | 5 |

CLIPS Search Results - Top 20 of 117

| | Formula | Mono Isotope | Mass Error (mDa) | Mass Error (PPM) | Spectral Accuracy | RMSE | DBE |
|---|---|---|---|---|---|---|---|
| 1 | C25H23N2OS | 399.1531 | -9.9091 | -24.8258 | 99.1292 | 97,910 | 15.5 |
| 2 | C26H23O2S | 399.1419 | 1.3243 | 3.3179 | 99.0431 | 107,587 | 15.5 |
| 3 | C22H19N5S | 399.1392 | 4.0097 | 10.0457 | 98.2935 | 191,871 | 16.5 |
| 4 | C21H23N2O4S | 399.1379 | 5.3471 | 13.3964 | 96.4481 | 399,355 | 11.5 |
| 5 | C20H23N4O3S | 399.1491 | -5.8863 | -14.7474 | 96.1278 | 435,373 | 11.5 |
| 6 | C24H19N2O4 | 399.1345 | 8.7179 | 21.8415 | 96.0291 | 446,474 | 16.5 |
| 7 | C22H27N2OS2 | 399.1565 | -13.2799 | -33.2710 | 95.9208 | 458,642 | 10.5 |
| 8 | C23H27O2S2 | 399.1452 | -2.0465 | -5.1272 | 95.9006 | 460,919 | 10.5 |
| 9 | C23H19N4O3 | 399.1457 | -2.5155 | -6.3022 | 95.7385 | 479,148 | 16.5 |
| 10 | C25H15N5 | 399.1358 | 7.3805 | 18.4908 | 95.6524 | 488,822 | 21.5 |
| 11 | C22H19N5O2 | 399.1569 | -13.7489 | -34.4460 | 95.4362 | 513,132 | 16.5 |
| 12 | C28H19N2O | 399.1497 | -6.5382 | -16.3807 | 95.3919 | 518,111 | 20.5 |
| 13 | C29H19O2 | 399.1385 | 4.6951 | 11.7631 | 95.3846 | 518,931 | 20.5 |
| 14 | C20H23N4OS2 | 399.1313 | 11.8722 | 29.7443 | 95.2078 | 538,814 | 11.5 |
| 15 | C19H23N5S2 | 399.1426 | .6389 | 1.6006 | 95.1043 | 550,450 | 11.5 |
| 16 | C22H23O7 | 399.1444 | -1.1781 | -2.9516 | 95.0179 | 560,166 | 11.5 |
| 17 | C20H15N8O2 | 399.1318 | 11.4032 | 28.5693 | 94.7196 | 593,705 | 17.5 |
| 18 | C21H23N2O6 | 399.1556 | -12.4115 | -31.0953 | 94.6564 | 600,807 | 11.5 |
| 19 | C17H19N8O2S | 399.1352 | 8.0324 | 20.1241 | 94.5441 | 613,439 | 12.5 |
| 20 | C19H15N10O | 399.1430 | .1698 | .4255 | 94.3756 | 632,384 | 17.5 |

Fig. 7

INTERACTIVE METHOD FOR IDENTIFYING IONS FROM MASS SPECTRAL DATA

This application claims priority under 35 U.S.C. §119(e) from provisional patent application 61/057,804 filed on May 30, 2008, the entire contents of which are incorporated herein by reference for all purposes.

CROSS REFERENCE TO RELATED PATENT APPLICATIONS/PATENTS

The entire contents of the following documents are incorporated herein by reference in their entireties:
U.S. Pat. No. 6,983,213; International Patent Application PCT/US2004/013096, filed on Apr. 28, 2004; U.S. patent application Ser. No. 11/261,440, filed on Oct. 28, 2005; International Patent Application PCT/US2005/039186, filed on Oct. 28, 2005; International Patent Application PCT/US2006/013723, filed on Apr. 11, 2006; U.S. patent application Ser. No. 11/754,305, filed on May 27, 2007; International Patent Application PCT/US2007/069832, filed on May 28, 2007; and U.S. provisional patent application Ser. No. 60/941,656, filed on Jun. 2, 2007.

BACKGROUND OF THE INVENTION

1. Field of the Invention

The present invention relates to mass spectrometry systems. More particularly, it relates to mass spectrometry systems that are useful for the analysis of complex mixtures of molecules, including large and small organic molecules such as proteins or peptides, environmental pollutants, pharmaceuticals and their metabolites, and petrochemical compounds, to methods of analysis used therein, and to a computer program product having computer code embodied therein for causing a computer, or a computer and a mass spectrometer in combination, to affect such analysis.

2. Prior Art

A previous approach, as in U.S. Pat. No. 6,983,213, International Patent Application PCT/US2005/039186, filed on Oct. 28, 2005, and U.S. provisional patent application Ser. No. 60/941,656, filed on Jun. 2, 2007 provides a novel method for calibrating mass spectra for improved mass accuracy and line shape correction to improve the ability to perform elemental composition analysis or formula identification.

Very high mass accuracy can be obtained on so-called unit mass resolution systems in accordance with the techniques taught in U.S. Pat. No. 6,983,213.

Accurate line shape calibration provides an additional metric to assist in the unambiguous formula identification by matching the measured spectra to the calculated spectra of candidate formulas, as in International Patent Application PCT/US2005/039186, filed on Oct. 28, 2005.

For higher resolution mass spectrometers where the monoisotopic peak is baseline resolved from the rest of the isotopes, accurate line shape calibration can be performed even without the use of either internal or external calibration standards by simply using the monoisotopic peak of the unknown ion itself as the peak shape calibration standard, as in U.S. provisional patent application Ser. No. 60/941,656, filed on Jun. 2, 2007.

However, obtaining correct elemental compositions from conventional to high resolution mass spectrometry systems remains a challenge to practitioners of mass spectrometry due to the enormous number of possible formulas within a given accurate mass tolerance and the highly tedious process of deciding which elements to consider for the elemental composition.

There exists a significant gap between what the current mass spectral system can offer and what is being achieved at the present using existing technologies for mass spectral analysis.

SUMMARY OF THE INVENTION

It is an object of the invention to provide a mass spectrometry system and a method for operating a mass spectrometry system that overcomes the difficulties described above, in accordance with the methods described herein.

It is another object of the invention to provide a storage media having thereon computer readable program code for causing a mass spectrometry system to perform the method in accordance with the invention.

An additional aspect of the invention is, in general, a computer readable medium having thereon computer readable code for use with a mass spectrometer system having a data analysis portion including a computer, the computer readable code being for causing the computer to analyze and interpret data by performing the methods described herein. The computer readable medium preferably further comprises computer readable code for causing the computer to perform at least one the specific methods described.

Of particular significance, the invention is also directed generally to a mass spectrometer system for analyzing chemical composition, the system including a mass spectrometer portion, and a data analysis system, the data analysis system operating by obtaining calibrated continuum spectral data by processing raw spectral data; generally in accordance with the methods described herein. The data analysis portion may be configured to operate in accordance with the specifics of these methods. Preferably the mass spectrometer system further comprises a sample preparation portion for preparing samples to be analyzed, and a sample separation portion for performing an initial separation of samples to be analyzed. The separation portion may comprise at least one of an electrophoresis apparatus, a chemical affinity chip, or a chromatograph for separating the sample into various components.

BRIEF DESCRIPTION OF THE DRAWINGS

The foregoing aspects and other features of the present invention are explained in the following description, taken in connection with the accompanying drawings, wherein:

FIG. 5 is a list of candidate formulas obtained during the process of FIG. 2.

FIG. 7 is another list of candidate formulas obtained during the iterative process of FIG. 2.

DETAILED DESCRIPTION OF THE PREFERRED EMBODIMENTS

Figure 1:
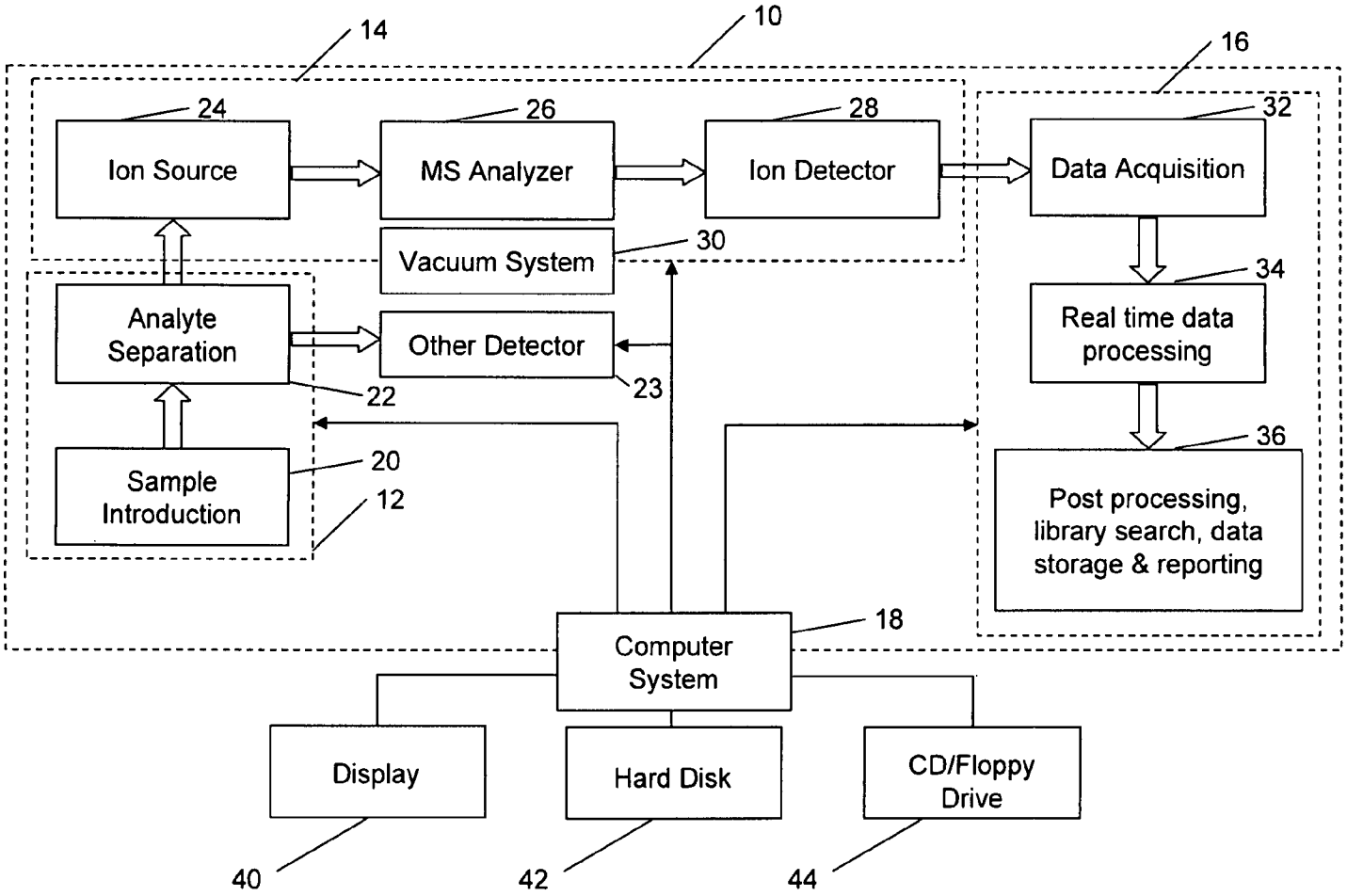
FIG. 1 is a block diagram of a mass spectrometer in accordance with the invention.

Referring to FIG. 1, there is shown a block diagram of an analysis system 10, that may be used to analyze proteins or other molecules, as noted above, incorporating features of the present invention. Although the present invention will be described with reference to the single embodiment shown in the drawings, it should be understood that the present invention can be embodied in many alternate forms of embodiments. In addition, any suitable types of components could be used.

Analysis system 10 has a sample preparation portion 12, other detector portion 23, a mass spectrometer portion 14, a data analysis system 16, and a computer system 18. The sample preparation portion 12 may include a sample introduction unit 20, of the type that introduces a sample containing proteins, peptides, or small molecule drug of interest to system 10, such as LCQ Deca XP Max, manufactured by Thermo Fisher Scientific Corporation of Waltham, Mass., USA. The sample preparation portion 12 may also include an analyte separation unit 22, which is used to perform a preliminary separation of analytes, such as the proteins to be analyzed by system 10. Analyte separation unit 22 may be any one of a chromatography column, an electrophoresis separation unit, such as a gel-based separation unit manufactured by Bio-Rad Laboratories, Inc. of Hercules, Calif., or other separation apparatus as is well known in the art. In electrophoresis, a voltage is applied to the unit to cause the proteins to be separated as a function of one or more variables, such as migration speed through a capillary tube, isoelectric focusing point (Hannesh, S. M., *Electrophoresis* 21, 1202-1209 (2000), or by mass (one dimensional separation)) or by more than one of these variables such as by isoelectric focusing and by mass. An example of the latter is known as two-dimensional electrophoresis.

The mass spectrometer portion 14 may be a conventional mass spectrometer and may be any one available, but is preferably one of MALDI-TOF, quadrupole MS, ion trap MS, qTOF, TOF/TOF, or FTMS. If it has a MALDI or electrospray ionization ion source, such ion source may also provide for sample input to the mass spectrometer portion 14. In general, mass spectrometer portion 14 may include an ion source 24, a mass analyzer 26 for separating ions generated by ion source 24 by mass to charge ratio, an ion detector portion 28 for detecting the ions from mass analyzer 26, and a vacuum system 30 for maintaining a sufficient vacuum for mass spectrometer portion 14 to operate most effectively. If mass spectrometer portion 14 is an ion mobility spectrometer, generally no vacuum system is needed and the data generated are typically called a plasmagram instead of a mass spectrum.

In parallel to the mass spectrometer portion 14, there may be other detector portion 23, where a portion of the flow is diverted to for nearly parallel detection of the sample in a split flow arrangement. This other detector portion 23 may be a single channel UV detector, a multi-channel UV spectrometer, or Reflective Index (RI) detector, light scattering detector, radioactivity monitor (RAM) etc. RAM is most widely used in drug metabolism research for $^{14}$C-labeled experiments where the various metabolites can be traced in near real time and correlated to the mass spectral scans.

The data analysis system 16 includes a data acquisition portion 32, which may include one or a series of analog to digital converters (not shown) for converting signals from ion detector portion 28 into digital data. This digital data is provided to a real time data processing portion 34, which processes the digital data through operations such as summing and/or averaging. A post processing portion 36 may be used to do additional processing of the data from real time data processing portion 34, including library searches, data storage and data reporting.

Computer system 18 provides control of sample preparation portion 12, mass spectrometer portion 14, other detector portion 23, and data analysis system 16, in the manner described below. Computer system 18 may have a conventional computer monitor or display 40 to allow for the entry of data on appropriate screen displays, and for the display of the results of the analyses performed. Computer system 18 may be based on any appropriate personal computer, operating for example with a Windows® or UNIX® operating system, or any other appropriate operating system. Computer system 18 will typically have a hard drive 42 or other type of data storage medium, on which the operating system and the program for performing the data analysis described below, is stored. A removable data storage device 44 for accepting a CD, floppy disk, memory stick or other data storage medium is used to load the program in accordance with the invention on to computer system 18. The program for controlling sample preparation portion 12 and mass spectrometer portion 14 will typically be downloaded as firmware for these portions of system 10. Data analysis system 16 may be a program written to implement the processing steps discussed below, in any of several programming languages such as C++, JAVA or Visual Basic.

As mentioned in the U.S. Pat. No. 6,983,213, it is always preferred to have mass spectral data acquired in the profile (sometimes called raw or continuum) mode in order to preserve all key information about the ions under observation (Step 210 in FIG. 2).

When it comes to elemental composition determination such as in metabolite identification application described above, mass spectrometry at high mass accuracy is a powerful tool used for compound ID or validation by virtue of the fact that every unique chemical formula has a unique mass, as referenced in Blaum, K., Physics Reports, Volume 425, Issues 1, March 2006, Pages 1-78. However, even at very high mass accuracy (1-5 ppm) there are still a significant number of formula candidates to consider as all compounds within the mass error window must be considered, which can be a very large number, as referenced in Kind, T. *BMC Bioinformatics* 2006, 7, 234. Traditionally, the list of compound candidates can be reduced by limiting the possible elements and applying other chemical constraints, but the list can still easily contain many tens of compounds. For a given compound (ion), the isotope pattern is also unique even if the individual isotopes and isobars are not fully resolved. Simple measurement of the relative intensities of the isotope peaks (M, M+1, M+N . . . ) can be a useful additional metric for paring down the composition list particularly for Br—, Cl—, or S—containing compounds with their unique isotope patterns, as referenced in Kind, T. *BMC Bioinformatics* 2006, 7, 234. Other approaches include simple computer modeling, as referenced in Evans, J. E.; Jurinski, N. B. Anal. Chem. 1975, 47, 961-963b Tenhosaari, A. Org. Mass Spectrom. 1988, 23, 236-239.

Do Lago, C. L.; Kascheres, C. Comput. Chem. 1991, 15, 149-155.

More elaborate approaches have been proposed involving the fitting of Gaussian or other assumed mathematical curves to the isotope distribution in an attempt to model the isotope pattern, as referenced in U.S. Pat. No. 6,188,064. However, all of these approaches are only rough approximations to the true isotope pattern because the actual measured line shape is either unknown or not available for use, resulting in modeling errors as large as a few percent, the level of error overwhelming the subtle differences from one formula to another, and largely limiting the usefulness of isotope pattern modeling.

In elemental formula determination approaches in currently available hardware and software systems, including the cross referenced related patent applications/patents, there are no interactive visual tools to aid in the determination process, during which some elements may need to be added or deleted, the number of included elements may need to be adjusted, the chemistry constraints such as double bond equivalence may need to be changed, and the charge state may also need to be adjusted. This application discloses here a novel interactive visual approach to address these deficiencies.

As noted above, previous approaches and/or documents referred to herein, have shown a method by which in using a known calibration ion or ions (either just its mono isotopic peak or the entire isotope profile), accurate correction of the instrument line shape to a known mathematical function can be performed while simultaneously calibrating for the mass axis. The calibration standard can be acquired separately, included in the mix when run with the unknown, as an internal standard and acquired simultaneously, or acquired along with the unknowns at different retention times during the same chromatographic separation.

For example, as mentioned in the U.S. Pat. No. 6,983,213, for a given standard ion of known elemental composition, the acquired profile mode mass spectral data $y_0$ and its theoretical counterpart y are related to each other through $$(g^{\otimes} y_0)=(g^{\otimes} y)^{\otimes} p \qquad \text{Equation 1}$$

where ⊗ represents convolution, g represents a small Gaussian, and p represents the mass spectral peak shape function. When $y_0$, y, and g are known, the actual mass spectral peak shape function p can be readily calculated through deconvolution.

It is not always convenient or desirable, or it may simply be impractical to run a separate calibration standard to obtain the actual peak shape function described above. Some of these situations include:

- For instruments capable of generating highly resolved mass spectral data such as FT ICR MS or high end quadrupole or ion traps operating in zoom scan (enhanced or high resolution) mode, there already exists a well characterized and well resolved peak shape function given by the monoisotopic peak or any other fully resolved pure isotopic peak of the unknown ion itself.
- For experiments with significant interferences, such as biological samples where it is difficult or impossible to obtain an internal calibration compound free from interferences. While one has the option for external calibration in these cases, it does involve another experiment, which introduces time-related variations into the experiment, or additional ion sources such as a dual spray or lock spray ion source, which comes at higher cost and complexity.

In all of these situations, the analysis would still benefit significantly if the actual peak shape function can be utilized. This is disclosed in U.S. provisional patent application Ser. No. 60/941,656, filed on Jun. 2, 2007.

Once the peak shape function p is obtained, one may optionally proceed with the mass spectral calibration as referenced in U.S. Pat. No. 6,983,213 to calibrate for the mass axis, while also transforming the actual peak shape into a desired or target peak shape function that is mathematically definable. Alternatively, but less desirably, one could leave the raw mass spectral data as is, except that the actual peak shape function is now known and numerically represented by p, as outlined in Step 210A in FIG. 2. Throughout this specification, the term actual peak shape function will be used to represent either the mathematically definable peak shape function (also called the desired or target peak shape function) or the numerically defined peak shape function obtained directly from a section of a mass spectrum with or without numerical operations such as baseline subtraction, interpolation, or calculation of the type given by Equation 1.

In order for the mass spectral calibration procedure outlined in U.S. Pat. No. 6,983,213 to work with a single monoisotope peak as a calibration standard, one needs to determine a known elemental composition for this calibration ion, which may be unknown at the moment. There are several ways to handle this:

1. Obtain an accurate mass reading for the monoisotope peak and perform a formula search in a small mass window and pick any formula candidate as the calibrant. Since only the monoisotope peak will be used for calibration, the actual elemental composition that gives rise to the fine isotope structures starting from M+1 onwards would not play a part.
2. Generate a delta function or stick located precisely at the reported accurate mass location with relative abundance, arbitrarily setting it at 100.00%, representing the complete isotope distribution for this fictional and isotopically pure "ion".

Advantages of this self-calibration approach include:

No known calibration compound is required for the calibration

It is known that mass spectral calibrations perform best when the calibrant is close in mass to the compound of interest, and is measured as close as possible to the retention time for the compound of interest, in order to minimize the effect of instrument drift. By definition this Self-Calibration approach is nearly ideal.

Another benefit to calibrating to a known and mathematically definable (also called a desired or target) line shape is the possibility of performing highly accurate background interference correction or of performing any other mathematical data analysis, including multivariate statistical analysis. Calibrating a complex run, such as from a biological matrix, to a known mathematical line shape will significantly improve the ability to discriminate among different sample types associated with a particular biological expression such as is the case in biomarker discovery, through approaches such as principle component analysis.

The referenced U.S. Pat. No. 6,983,213 provides an approach for the use of actual peak shape function in the subsequent peak analysis outlined in Step 210A in FIG. 2. Due to the fact that the actual peak shape function is used for the mass spectral peak detection and centroiding, better mass accuracy and peak area determination can be obtained to enable elemental composition determination even on a single quadrupole mass spectrometer, a feat previously considered unfeasible.

Figure 2:
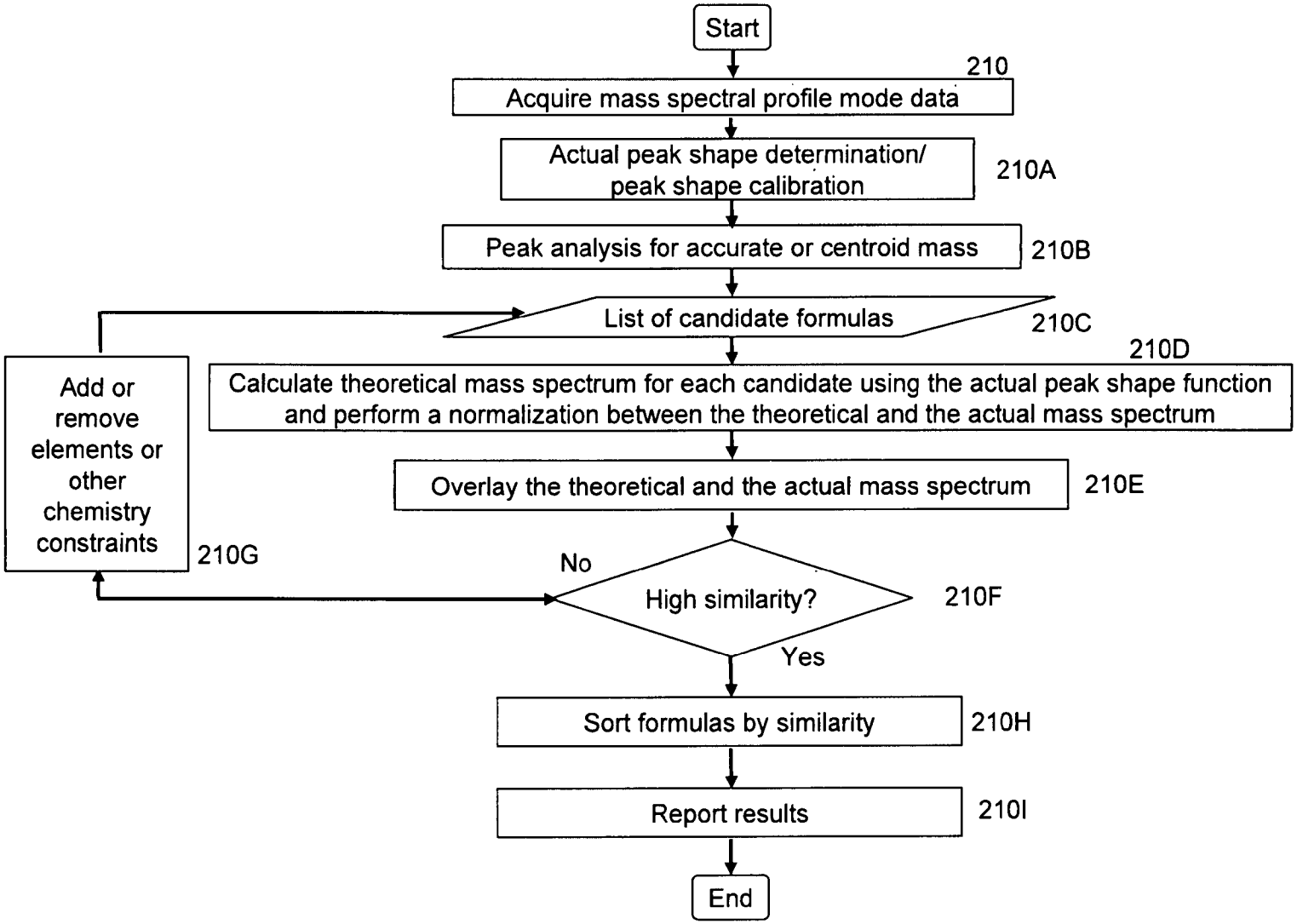
FIG. 2 is flow chart of the possible steps in the mass spectral identification of ions used by the system of FIG. 1.

Once the accurate mass is obtained, typically for the monoisotopic peak of the unknown ion, one may proceed to Step 210C in FIG. 2 to generate a list of possible candidate formulas by assuming some chemistry constraints such as a limited list of elements, including particular isotopes such as $^{14}C$, a minimum and maximum number for each element, charge state, electron state (even or odd or both), and double bond equivalence and by specifying a mass tolerance window during the initial consideration. It is important to note that, while it is necessary to place these initial constraints on the chemistry and mass tolerance in order to reduce the number of candidate formulas to a manageable number, these initial constraints may inadvertently drop the correct formula from the list due precisely to any one of the constraints placed on these candidate formulas. For example, for an FT ICR MS instrument operating at 1,000,000:1 resolving power, it is expected that the mass error would typically fall within 1 ppm. If by chance or by lack of calibration, the correct formula happens to have a mass error of 2.1 ppm, a mass tolerance window of 1 ppm used in generating the candidate formulas would have left the correct formula out, and could result in the incorrect formula being determined. This is a significant concern that the current application addresses.

For each formula on the list of candidate formulas, its theoretical isotope distribution can be readily calculated. By definition, the theoretical isotope distribution comes in the form of a discrete distribution, not a continuum distribution. In order to compare accurately and quantitatively the theoretical distribution and the actual mass spectral data so as to differentiate among the many candidate formulas generated from Step 210C in FIG. 2, the discrete theoretical isotope distribution is converted to a continuum mass spectrum comparable to the actual mass spectral data. Alternatively and less desirably, the actual mass spectrum is converted to a discrete distribution comparable to the theoretical isotope distribution. The former approach has the advantage of preserving all isotopic information in the actual mass spectral data, regardless of whether these isotopes are mass spectrally resolved or not, and is therefore independent of the mass spectral resolving power, while the latter approach, by the nature of finite mass spectral resolution, almost always leads to errors arising from centroiding actual mass spectral data. The latter approach, nonetheless, does avoid the issue of converting discrete theoretical isotope distribution into a continuum mass spectrum, which requires applying the actual peak shape function to the theoretically calculated discrete isotope distribution. It is noted that in order to achieve the level of accuracy needed to differentiate closely related formulas which resemble each other, the actual peak shape function, not an assumed and approximated peak shape function such as a Gaussian, should be applied. This process of converting the theoretically calculated isotope distribution into a theoretical mass spectrum is depicted as part of Step 210D in FIG. 2.

In addition to the actual peak shape function, there exist other significant differences that need to be addressed before accurately and quantitatively comparing the theoretical and actual mass spectrum. A theoretical mass spectrum can be calculated at any arbitrary intensity scale, while the actual mass spectrum may come in any given level of system counts, depending on the analog and digital gains built into the hardware and software system, the ionization efficiency of the ion source, the mass spectral transmission efficiency through the mass analyzer, the sample concentration, and any co-existing ions with ion suppression or enhancing effects etc. Furthermore, the actual mass spectrum may come with background ions, interference ions, and baselines. Lastly, the actual mass spectrum may not be located at exactly the same mass location as the theoretical mass spectrum, due to any residual mass error from even the highly accurate mass measurement and calibration. For these reasons, there should be a normalization step before the mass spectral overlay in Step 210E in FIG. 2.

The normalization included in Step 210D may take the form of $$r = Kc + e \qquad \text{Equation 2}$$

where r is an (n×1) matrix of the actual mass spectral data, digitized at n m/z values; c is a (p×1) matrix of regression coefficients which are representative of the concentrations of p components in matrix K; K is an (n×p) matrix composed of mass spectral responses for the p components, all sampled at the same n m/z points as r; and e is an (n×1) matrix of a fitting residual with contributions from random noise and any systematic deviations from this model. The p columns of the matrix K may contain the theoretical mass spectrum t and any background, mass spectra of any interfering ions, or baseline components, which may or may not vary with mass. Columns may also be added into matrix K to contain derivative terms of either the actual mass spectrum or theoretical mass spectrum so as to compensate for any residual mass shift, as disclosed in the cross-referenced International Patent Application PCT/US2004/013096 filed on Apr. 28, 2004.

In the above Equation 2, it should be noted that the vectors r and t can be switched to achieve better computational efficiency, where the matrix K is fixed for all candidate formulas and needs to be inverted only once for normalizing the theoretical mass spectra of each different candidate formula.

The estimation of concentration vector c is first obtained as, $$\hat{c} = K^{+} r \qquad \text{Equation 3}$$

where $K^{+}$ is the pseudo inverse of matrix K, a process well established in matrix algebra, as referenced in U.S. Pat. No. 6,983,213; International Patent Application PCT/US2004/013096, filed on Apr. 28, 2004; U.S. patent application Ser. No. 11/261,440, filed on Oct. 28, 2005; International Patent Application PCT/US2005/039186, filed on Oct. 28, 2005; International Patent Application PCT/US2006/013723, filed on Apr. 11, 2006; and U.S. provisional patent application Ser. No. 60/941,656, filed on Jun. 2, 2007. The $\hat{c}$ is the estimated concentration vector c, which can be inserted back into Equation 2 to arrive at a normalized or fitted mass spectral response $\hat{r}$, $$\hat{r} = K\hat{c} \qquad \text{Equation 4}$$

The normalized mass spectrum $\hat{r}$ and the actual mass spectrum r can now be displayed as overlays in Step 210E in FIG. 2 to visually observe the difference as residual vector e, $$\hat{e} = r - \hat{r} \qquad \text{Equation 5}$$

This residual vector can be plugged into the following equation for the calculation of a numeric metric to accurately measure the similarity between the two (Step 210F in FIG. 2). One such metric is termed Spectral Accuracy, which can be calculated for each given candidate formula's theoretical mass spectrum t, $$SA = \left(1 - \frac{\|e\|_2}{\|r\|_2}\right) \times 100 \qquad \text{Equation 6}$$

The Spectral Accuracy (SA) thus calculated will be 100% if the actual mass spectrum r matches a theoretical mass spectrum exactly. In the absence of random or systematic error, the Spectral Accuracy would be 100% for the correct formula. In practice with ion counting noise on a well calibrated mass spectrometer, the Spectral Accuracy can reach more than 99% to enable unique formula determination even on a single quadrupole MS system.

As noted in Step 210A in FIG. 2, although it is desirable to have the profile mode data acquired at Step 210 calibrated into a known mathematical peak shape function through Step 210A, this peak shape calibration can also be omitted, as long as the actual peak shape function is obtained and used in the subsequent steps where a theoretical mass spectrum is calculated. In this case, in Step 210D, the theoretical mass spectrum is calculated by using the actual peak shape function obtained in Step 210A, instead of the desired or target peak shape function specified during the optional calibration process such as the one referenced in U.S. Pat. No. 6,983,213. Correspondingly, the normalization in Step 210D or calculation of a similarity metric in Step 210F can be performed either between the raw mass spectral data (called actual mass spectral data) and the theoretical mass spectral data with the actual peak shape function applied, or between the calibrated mass spectral data (also called actual mass spectral data) and the theoretical mass spectral data with the desired or target peak shape function applied, all using the approaches disclosed in International Patent Applications PCT/US2004/013096 filed on Apr. 28, 2004 and PCT/US2005/039186, filed on Oct. 28, 2005.

At Step 210F in FIG. 2, if the Spectral Accuracy is less than expected and the spectral overlay in Step 210E reveals significant systematic error (lack of congruence) between the theoretical mass spectrum and the actual mass spectrum, the given candidate formula is likely not the correct one and other formulas with better Spectral Accuracy and better congruence may need to be considered. If even the formula with the highest Spectral Accuracy does not provide a good mass spectral overlay, that is, achieve good congruence, there is strong indication that the correct formula may not even be on the list due to the constraints placed on formula generation during Step 210C and one may need to go to Step 210G to adjust the one or more of these constraints and repeat the process from Step 210C to 210F again until satisfactory Spectral Accuracy and good congruence is achieved with a perfect spectral overlay, subject only to the noise in the data. It should be noted that this novel iteration and formula evaluation process can be performed in real time in an interactive fashion to visually guide the user to arrive quickly at the correct formula. Convergence is achieved by using a combination of metrics, including the Spectral Accuracy metric among others, and most importantly the mass spectral overlay which best displays the overall mass spectral congruence, or lack thereof. Once an acceptable level of congruence is observed, taking all available metrics and known information into account, the list of formulas can be sorted by Spectral Accuracy or other pertinent metric in descending or ascending order, as appropriate (Step 210H in FIG. 2) with a report generated in Step 210I in FIG. 2.

Figure 3:
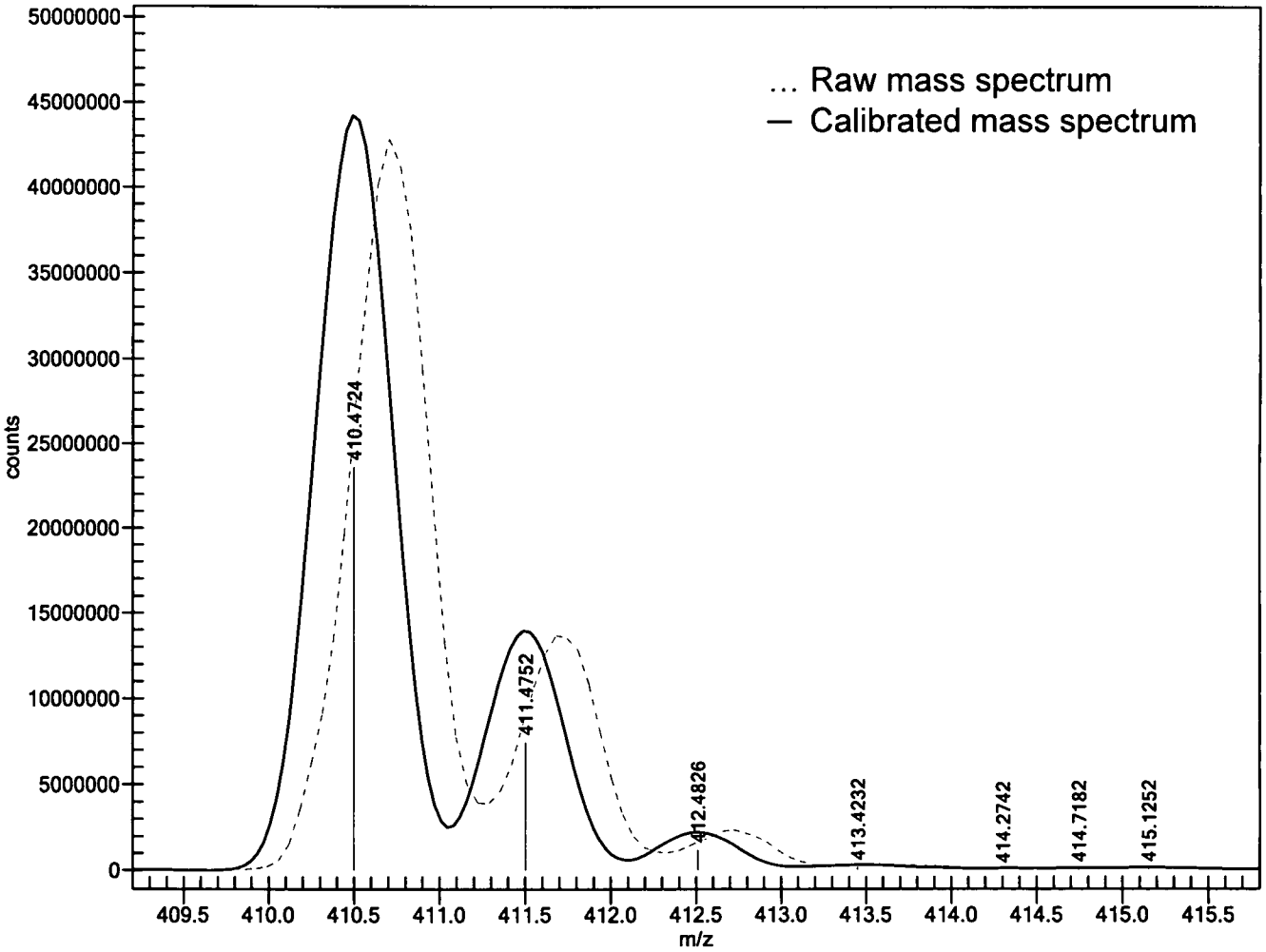
FIG. 3 and FIG. 4 are graphical representations of the mass spectra before and after peak shape calibration during the process of FIG. 2.
Figure 4:
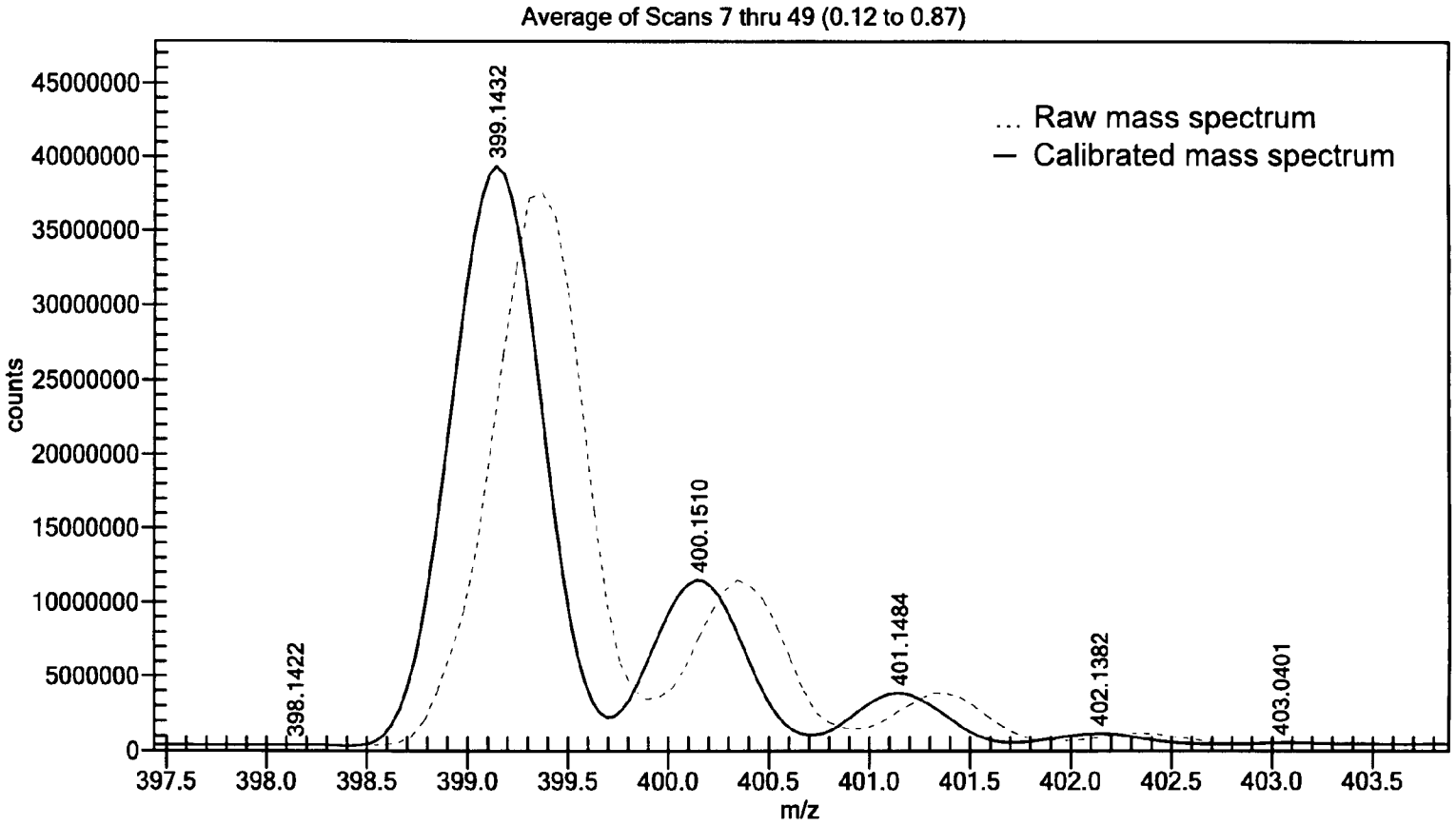

FIG. 3 shows a comparison between the raw mass spectral data and its calibrated version for the standard internal calibration ion at 410 Da, as result of Step 210A in FIG. 2. FIG. 4 shows a similar comparison for the unknown ion to be determined at 399 Da after applying the mass spectral calibration developed for the internal calibration ion at 410 Da, also as a result of Step 210A in FIG. 2. FIGS. 3 and 4 both show the mass (m/z) calibration and the peak shape calibration where the mass spectrum, after calibration, has a mathematically definable symmetrical peak shape function.

Figure 6:
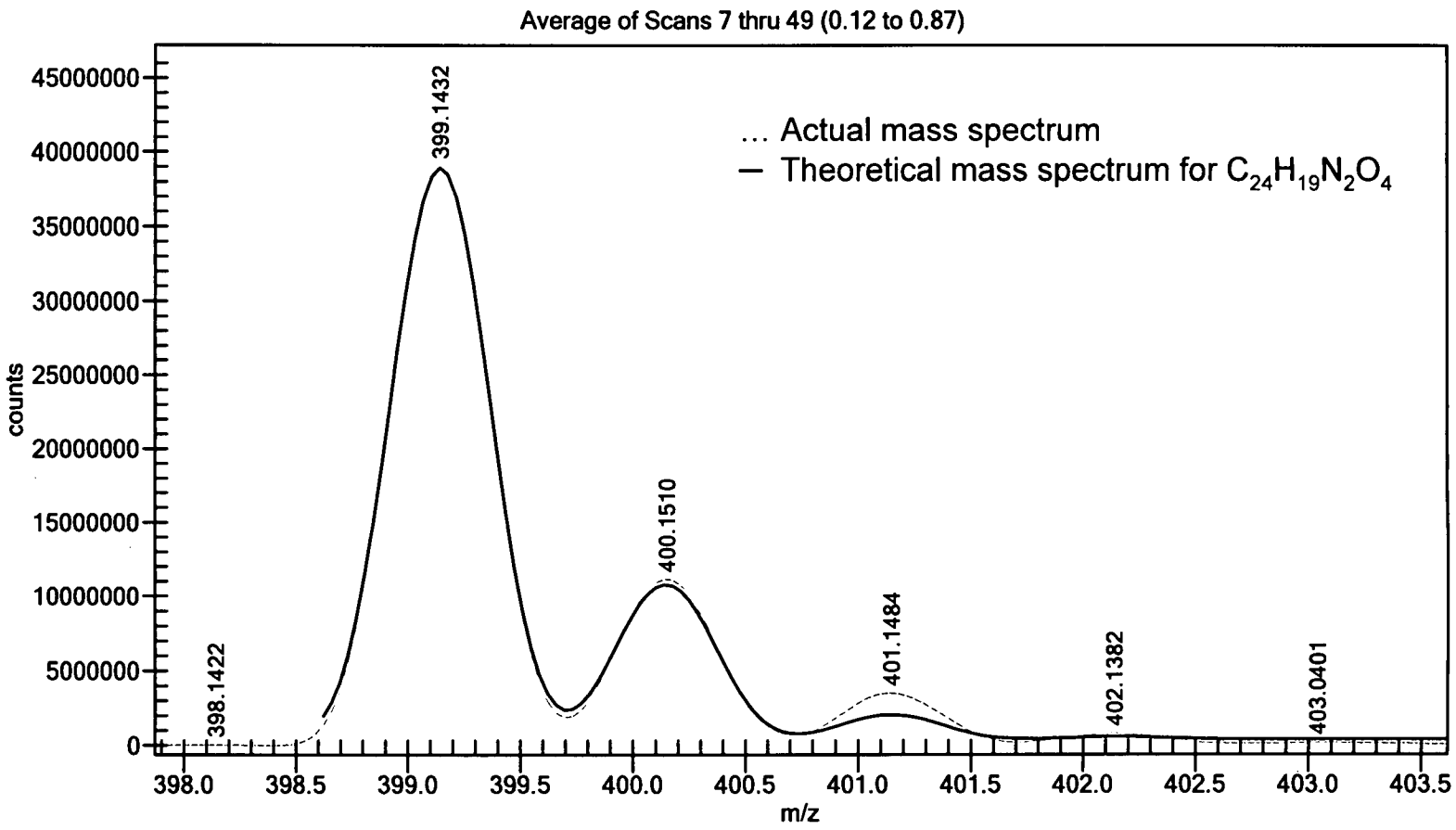
FIG. 6 is the spectral overlay between the actual mass spectral data and the theoretical mass spectrum calculated for the top hit formula given in FIG. 5.

Following Step 210B in FIG. 2, the accurate mass for the monoisotopic peak at 399 Da is determined to be 399.1432 Da as shown in FIG. 4. This monoisotopic mass can be used to generate a list of candidate formulas (Step 210C in FIG. 2), that are given in FIG. 5, subject to the mass tolerance and chemical constraints also indicated in FIG. 5. At this point, one can step through all the formulas listed in FIG. 5 in real time and interactively evaluate each candidate formula. The theoretical mass spectrum for the formula with the highest Spectral Accuracy at 96.03%, $C_{24}H_{19}N_2O_4$, is calculated and normalized in Step 210D and then displayed as overlays in FIG. 6 (Step 210E in FIG. 2), which clearly indicate that there is a mismatch between the theoretical mass spectrum and the actual mass spectrum, pointing to the possibility that the correct formula may not be on the list in FIG. 5.

Figure 8:
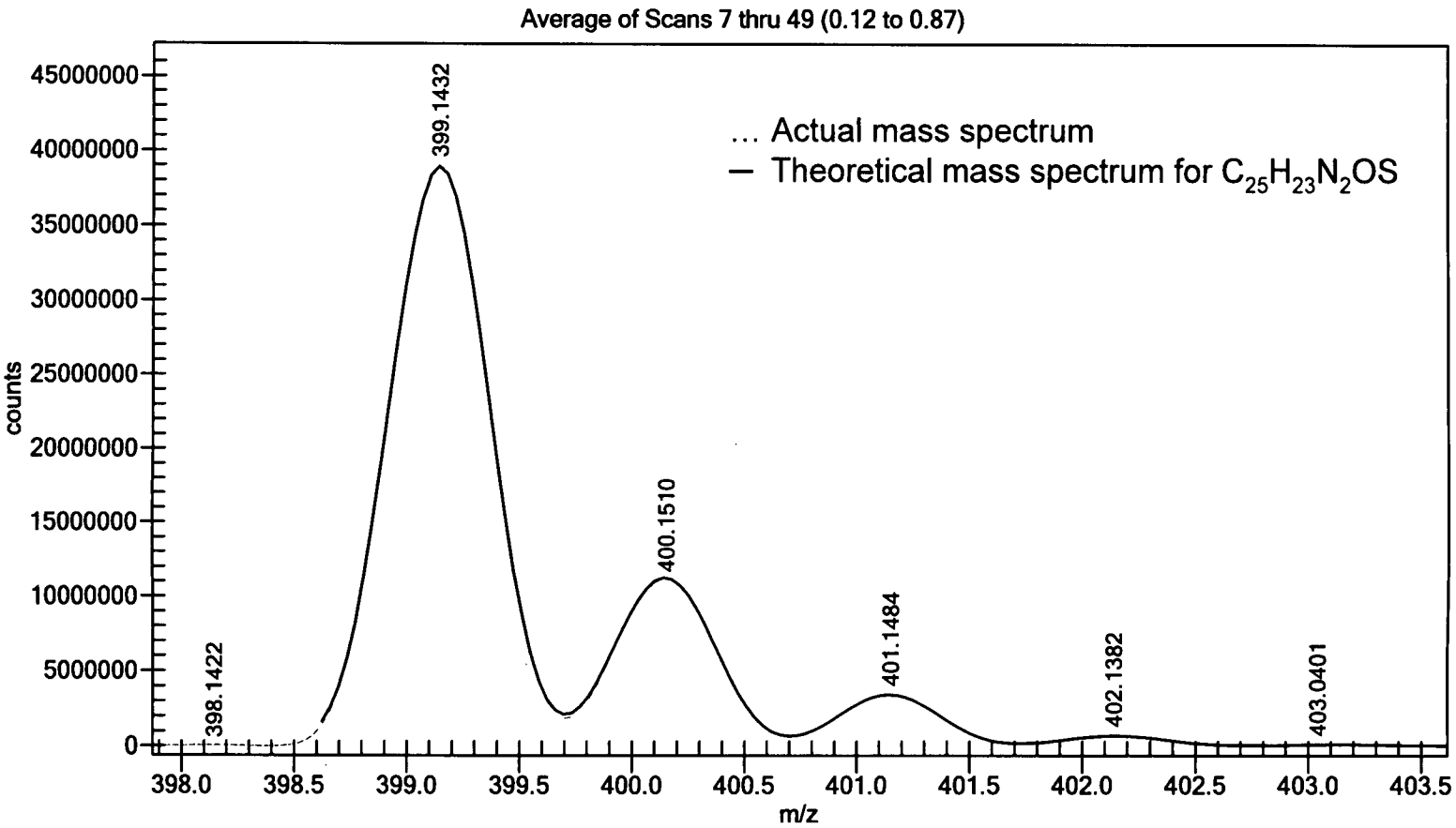
FIG. 8. is the spectral overlay between the actual mass spectral data and the theoretical mass spectrum calculated for the top hit formula given in FIG. 7.
Figure 9:
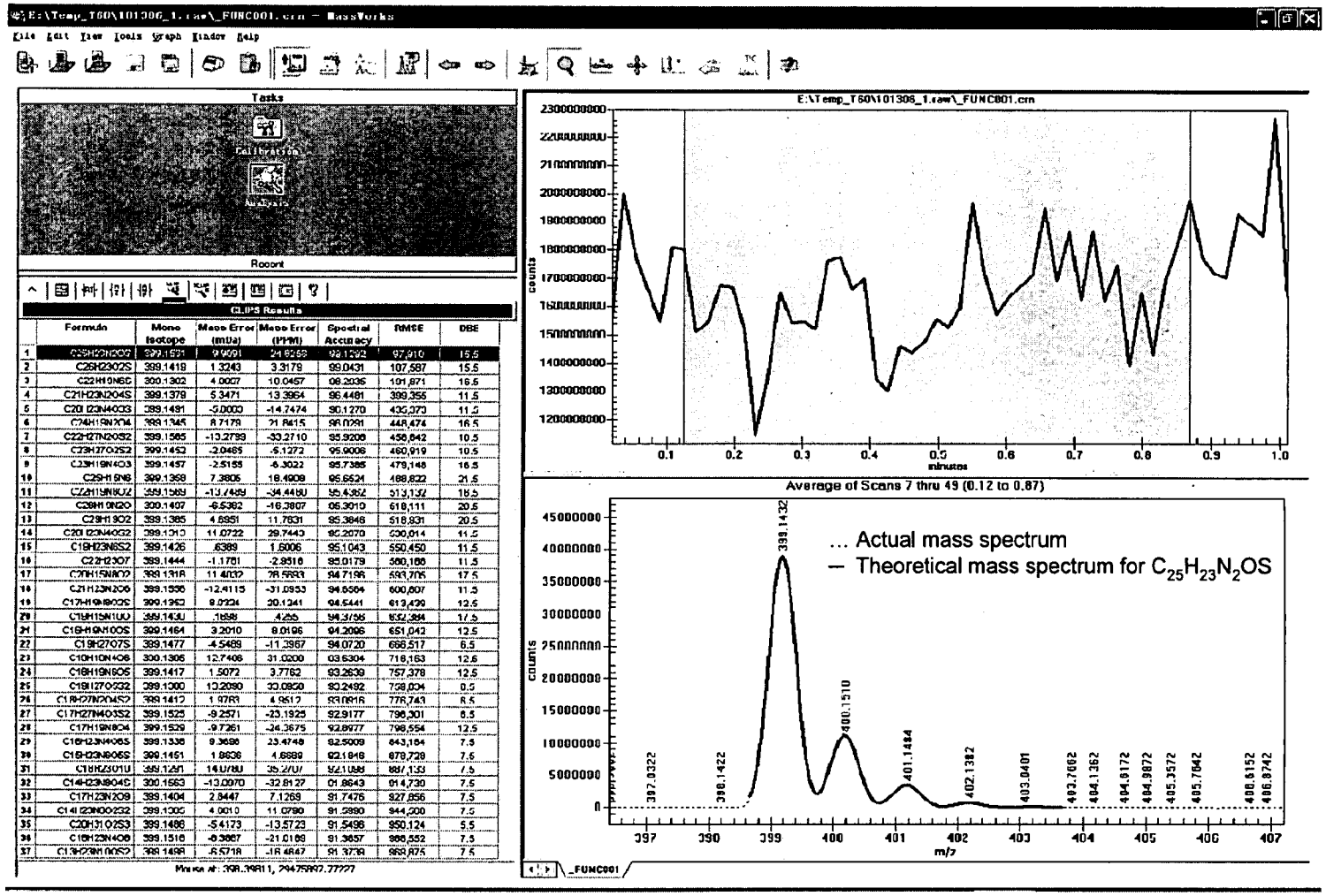
FIG. 9. is a screen shot from a software implementation of this novel interactive ion determination approach.

A new element, S, is then added to the element list (Step 210G in FIG. 2), and the entire process from Step 210C to Step 210F is repeated, resulting in a new list of candidate formulas in FIG. 7. The formula with the highest Spectral Accuracy of 99.13% is visually displayed in the spectral overlay of FIG. 8 with very high congruence between the theoretical and actual mass spectrum, pointing to the correct determination of the unknown formula as $C_{25}H_{23}N_2OS$. FIG. 9 shows a screenshot of one particular implementation of this novel approach for interactive ion formula determination.

The process described above includes a fairly comprehensive series of steps, for purposes of illustration, and to be complete. However, there are many ways in which the process may be varied, including leaving out certain steps, or performing certain steps before hand or "off-line". For example, it is possible to follow all the above approaches by including disjoining isotope segments (that is using isotope peaks that are separated in mass, but not using portions of the spectrum between the peaks), especially with data measured from higher resolution MS systems, so as to avoid the mass spectrally separated interference peaks that are located within, but are not directly overlapped, with the isotope cluster of an ion of interest. Furthermore, one may wish to include only the isotopic peaks that are not overlapped with interferences in the above analysis, using exactly the same vector or matrix algebra during the normalization Step 210D in FIG. 2 or the similarity metric calculating Step 210F in FIG. 2. If the disjoining isotope segments pose a mathematical difficulty in terms of derivative calculations, one may consider zero-filling the excluded regions in the isotope cluster before the relevant calculations. Lastly, one may wish to perform a weighted regression from Equation 2 to Equation 5 to better account for the signal variance, as referenced in U.S. Pat. No. 6,983,213.

For all the analysis described above, it may be advantageous to transform the m/z axis into another more appropriate axis before hand, to allow for analysis with a uniform peak shape function in the transformed axis, as pointed out in U.S. Pat. No. 6,983,213 and International Patent Application PCT/US2004/034618 filed on Oct. 20, 2004.

Conversely certain steps may be combined or performed at the same times as other steps. For example, if the monoisotope peak is deemed to be impure and overlapped with other monoisotope peaks in Step 210A and Step 210B in FIG. 2, one may use the same approach outlined for drug metabolism (with a mixture of native and labeled parent drug to deconvolute and determine their mix ratio as given in the cross-referenced U.S. Provisional Patent Application Ser. No. 60/941,656, filed on Jun. 2, 2007), and proceed with the subsequent analysis, which may involve the elemental composition determination with more than two overlapping ions by effectively augmenting the column in matrix K and corresponding vector c in Equations 2 to 5 (as disclosed in International Patent Application PCT/US2004/013096 filed on Apr. 28, 2004; International Patent Application PCT/US2005/039186, filed on Oct. 28, 2005; and International Patent Application PCT/US2006/013723, filed on Apr. 11, 2006). This augmentation effectively extends the concept of spectral accuracy (SA) in Equation 6 to cases with multiple ions in the mass spectral data vector r.

Additionally, some steps may be simplified or combined in specific situations. For example, the normalization step in Step 210D and the preferred embodiment from Equations 2 to 5 can be simplified to a straight scaling operation involving scalar division or multiplication, or in combination with a mass shift operation via spectral interpolation to align the actual mass spectrum with the theoretical mass spectrum or vice versa.

It is noted that the terms "mass" and "mass to charge ratio" are used somewhat interchangeably in connection with information or output as defined by the mass to charge ratio axis of a mass spectrometer. This is a common practice in the scientific literature and in scientific discussions, and no ambiguity will occur, when the terms are read in context, by one skilled in the art.

It is further noted that the terms "peak shape (function)" and "line shape (function)" are used somewhat interchangeably throughout this specification. This is a common practice in the scientific literature and in scientific discussions, and no ambiguity will occur, when the terms are read in context, by one skilled in the art.

The methods of analysis of the present invention can be realized in hardware, software, or a combination of hardware and software. Any kind of computer system—or other apparatus adapted for carrying out the methods and/or functions described herein—is suitable. A typical combination of hardware and software could be a general purpose computer system with a computer program that, when loaded and executed, controls the computer system, which in turn control an analysis system, such that the system carries out the methods described herein. The present invention can also be embedded in a computer program product, which comprises all the features enabling the implementation of the methods described herein, and which—when loaded in a computer system (which in turn control an analysis system), is able to carry out these methods.

Computer program means or computer program in the present context include any expression, in any language, code or notation, of a set of instructions intended to cause a system having an information processing capability to perform a particular function either directly or after conversion to another language, code or notation, and/or reproduction in a different material form.

Thus the invention includes an article of manufacture, which comprises a computer usable medium having computer readable program code means embodied therein for causing a function described above. The computer readable program code means in the article of manufacture comprises computer readable program code means for causing a computer to effect the steps of a method of this invention. Similarly, the present invention may be implemented as a computer program product comprising a computer usable medium having computer readable program code means embodied therein for causing a function described above. The computer readable program code means in the computer program product comprising computer readable program code means for causing a computer to effect one or more functions of this invention. Furthermore, the present invention may be implemented as a program storage device readable by machine, tangibly embodying a program of instructions executable by the machine to perform method steps for causing one or more functions of this invention.

It is noted that the foregoing has outlined some of the more pertinent objects and embodiments of the present invention. The concepts of this invention may be used for many applications. Thus, although the description is made for particular arrangements and methods, the intent and concept of the invention is suitable and applicable to other arrangements and applications. It will be clear to those skilled in the art that other modifications to the disclosed embodiments can be effected without departing from the spirit and scope of the invention. The described embodiments ought to be construed to be merely illustrative of some of the more prominent features and applications of the invention. Thus, it should be understood that the foregoing description is only illustrative of the invention. Various alternatives and modifications can be devised by those skilled in the art without departing from the invention. Other beneficial results can be realized by applying the disclosed invention in a different manner or modifying the invention in ways known to those familiar with the art. Thus, it should be understood that the embodiments has been provided as an example and not as a limitation. Accordingly, the present invention is intended to embrace all alternatives, modifications and variances which fall within the scope of the appended claims.

What is claimed is:

1. A method for identifying ions that generated mass spectral data, comprising:

acquiring raw mass spectral data in profile mode containing at least one ion of interest;

performing at least one of mass spectral calibration involving peak shape and a determination of actual peak shape function associated with the acquired raw mass spectral data;

considering at least one possible elemental composition of the ion;

calculating theoretical mass spectral data for said elemental composition using the actual peak shape function;

performing a normalization between corresponding parts of the theoretical mass spectral data and that of the raw or calibrated mass spectral data; and displaying mass spectral congruence between said theoretical mass spectral data calculated from said elemental composition and one of raw and calibrated mass spectral data after said normalization using spectral overlays for the determination of elemental composition of said ion associated with said mass spectral data.

2. The method of claim 1, wherein the actual peak shape function is one of peak shape function as measured and target peak shape function from a mass spectral calibration involving peak shape function.

3. The method of claim 2, wherein the actual peak shape function is obtained from at least one isotopic peak of an ion.

4. The method of claim 2, wherein the actual peak shape function is obtained from at least one standard ion of known elemental composition.

5. The method of claim 1, wherein the possible elemental composition is generated with accurate mass measurement from one of the isotopic masses belonging to the ion of interest within a given mass tolerance window.

6. The method of claim 1, wherein the theoretical mass spectral data is calculated through convolution between the theoretical isotope distribution and the actual peak shape function.

7. The method of claim 6, wherein the theoretical isotope distribution is calculated from the isotopic abundance of the elements involved in a given elemental composition.

8. The method of claim 1, wherein said normalization comprises at least one of mass axis shifting, spectral interpolation, intensity scaling, digital filtering, matrix multiplication, matrix inversion, convolution, deconvolution, regression, and optimization.

9. The method of claim 8, wherein said normalization comprises compensating for at least one of possible baseline, backgrounds, other known ions, or utilizing at least one of derivatives of actual mass spectral data and theoretical mass spectral data.

10. The method of claim 8, wherein said normalization also generate a numerical metric for said elemental composition to measure congruence between the theoretical mass spectral data and the raw or calibrated mass spectral data.

11. The method of claim 10, wherein the generated numerical metric is used as an indication of the likelihood of said elemental composition being the correct formula for the ion of interest.

12. The method of claim 10, wherein the numerical metric is derived from residual error of said normalization.

13. The method of claim 12, wherein the numerical metric is a spectral accuracy measure calculated as a function of the residual error such that a higher spectral accuracy corresponds to a smaller residual error and hence a higher probability that the corresponding formula is the correct formula.

14. The method of claim 1, wherein the raw mass spectral data is the profile mode mass spectral data, as acquired.

15. The method of claim 1, wherein the calibrated mass spectral data is the profile mode mass spectral data after a calibration involving at least peak shape function.

16. The method of claim 1, wherein the at least one of the display and numeric metric is used as a guide to add or eliminate one or more elements in said elemental composition.

17. The method of claim 1, wherein at least part of the steps are repeated for a different elemental composition.

18. The method of claim 1, wherein a plurality of elemental compositions are considered and the display is updated as each elemental composition is considered.

19. A computer programmed to perform the method of claim 1.

20. The computer of claim 19, in combination with a mass spectrometer for obtaining mass spectral data to be analyzed by said computer.

21. A computer readable medium having computer readable code thereon for causing a computer to perform the method of claim 1.

22. A mass spectrometer having associated therewith a computer for performing data analysis functions of data produced by the mass spectrometer, the computer performing the method of claim 1.

23. The method of claim 1, wherein if the mass spectral congruence indicates that correct elemental compositions have not been determined, elements are iteratively added or removed from the elemental composition to obtain better congruence.

* * * * *